United States Patent [19]

Benn et al.

[11] 4,386,976

[45] Jun. 7, 1983

[54] DISPERSION-STRENGTHENED NICKEL-BASE ALLOY

[75] Inventors: Raymond C. Benn, Suffern; LeRoy R. Curwick, Warwick; Kenneth R. Andryszak, Goshen, all of N.Y.

[73] Assignee: Inco Research & Development Center, Inc., Suffern, N.Y.

[21] Appl. No.: 163,222

[22] Filed: Jun. 26, 1980

[51] Int. Cl.[3] ..... C22C 19/05

[52] U.S. Cl. ..... 148/410; 148/428

[58] Field of Search ..... 75/171, 170; 148/32, 148/32.5

[56] References Cited

U.S. PATENT DOCUMENTS 3,591,362 7/1971 Benjamin ..... 75/0.5 BA 3,926,568 12/1975 Benjamin et al. ..... 75/171

*Primary Examiner*—R. Dean

*Attorney, Agent, or Firm*—Ewan C. MacQueen; Raymond J. Kenny

[57] ABSTRACT

An oxide dispersion-strengthened, nickel-base alloy containing special amounts of chromium, aluminum, tungsten, molybdenum and yttria has a combination of strength properties over a range of temperatures, together with substantial corrosion resistance.

7 Claims, 2 Drawing Figures

DISPERSION-STRENGTHENED NICKEL-BASE ALLOY

FIELD OF THE INVENTION

The invention described herein was made in the course of, or under a contract with the Naval Air Development Center for Naval Air Systems Command, Department of the Navy.

This invention relates to the field of oxide dispersion-strengthened nickel-base alloys.

BACKGROUND OF THE INVENTION

It has been known for years that dispersion of microfine refractory particles throughout a metal matrix greatly strengthens the metal at elevated temperatures. For example, uniform dispersions of fine thoria were achieved in the products known as TD-nickel and TD-nickel chromium which were produced from chemically precipitated mixtures, reduced to metal powder and consolidated by powder metallurgical techniques. These materials are characterized by high strength at temperatures on the order of 1800°(982° C.) to 2000° F. (1093° C.) but were never successful commercially because the strength at lower temperatures, e.g., 1400° F. (760° C.) or 1600° F. (871° C.), was inadequate.

The provision of metallic materials having continually increasing capabilities in terms of strength and corrosion resistance has been largely directed to the requirements of the gas turbine industry. This industry has been seeking to produce engines having ever increasing capabilities in terms of performance, increased service life and, particularly of late, improved economy in operation. The challenge of the gas turbine industry and, in particular, the designers of blades and vanes for use in the hot end of the gas turbine, has resulted in continual improvement in the properties of metallic materials adaptable for use in gas turbines. Engine designers have been equally adept at improving engine parts to take advantage of improvements in elevated temperature capability afforded by metallurgists and to provide design improvements such as blade cooling. The result has been provision of alloys having improved elevated temperature properties and the provision of engines of even greater capability and reliability.

However, the search for better materials and better engines is never-ending.

With the advent of the mechanical alloying process as described, for example, in U.S. Pat. No. 3,591,362, a new procedure for producing oxide dispersion-strengthened (ODS) metals and alloys which could be adjusted in composition was made available. The process has been adapted to provide ODS nickel-chromium alloys of improved properties, as exemplified by U.S. Pat. No. 3,926,568. Experimental work in developing ODS alloys produced from mechanically alloyed powder has revealed that the process has its own unique limitations and requirements. For example, it has been confirmed that such ODS alloys must be capable of developing a coarse, elongated grain structure in order to obtain good elevated temperature properties therein.

The alloy emanating from U.S. Pat. No. 3,926,568 has been named "MA 6000 E". While the alloy has excellent properties, even higher strength properties are desired. The present invention provides an ODS alloy produced from mechanically alloyed powder which provides such improved strength properties.

SUMMARY OF THE INVENTION

Figure 1:
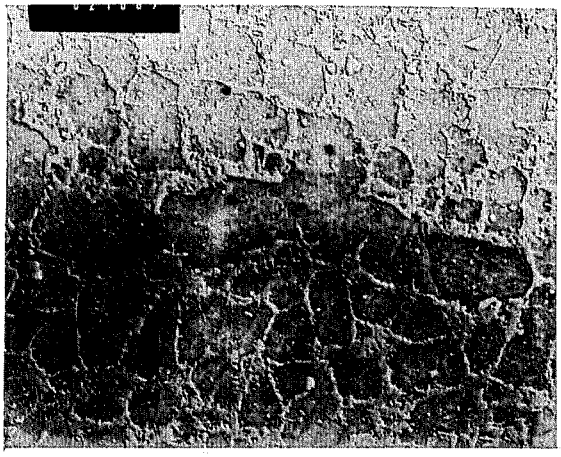
FIG. 1 depicts the microstructure taken at 4900 diameters of an alloy in accordance with the invention.

The invention is direct to an ODS nickel-base alloy which possesses a unique combination of strength properties over the range of temperatures of interest in the design of blades for gas turbines. An exemplary alloy contains, by weight, 9.3% chromium, 8.5% aluminum, 6.6% tungsten, 3.4% molybdenum, 0.15% zirconium, 0.01% boron, 1.1% yttria dispersoid and the balance essentially nickel. The alloy is amenable to processing from mechanically alloyed powder, can be zone annealed in the consolidated and wrought condition to produce coarse elongated grains and has high strength both at 1400° F. (760° C.) and at 2000° F. (1093° C.).

DESCRIPTION OF THE PREFERRED EMBODIMENT

The compositions, in weight percent, of three alloys in accordance with the invention are set forth in the following Table I:

TABLE I

| Alloy No. | % Ni | % Cr | % Al | % W | % Mo | % Ta | % Nb | % Zr | % B | % $Y_2O_3$ |
|---|---|---|---|---|---|---|---|---|---|---|
| 1 | 68.3 | 11.3 | 7.3 | 6.4 | 1.7 | 3.2 | 1.6 | 0.15 | 0.01 | 1.1 |
| 2 | 68.7 | 13.9 | 7.4 | 6.5 | 1.7 | 1.6 | — | 0.15 | 0.01 | 1.1 |
| 3 | 70.9 | 9.3 | 8.5 | 6.6 | 3.4 | — | — | 0.15 | 0.01 | 1.1 |

Each of the compositions was prepared by mechanical alloying of 8.5 kg batches in the 10S attritor using as raw materials nickel powder Type 123, elemental chromium, tungsten, molybdenum, tantalum and niobium, nickel-47.5% Al master alloy, nickel-28% zirconium master alloy, nickel-16.9% boron master alloy and yttria. In each case the powder was processed to homogeneity. Oxygen and iron levels were maintained in the range 0.5–0.8 weight percent each. Each powder batch was screened to remove particles exceeding 12 mesh, cone blended two hours and packed into mild steel extrusion cans which were sealed. Four extrusion cans were prepared for each composition. The cans were heated in the range 2000° F. to 2200° F. (1093° C. to 1204° C.) and extruded into either 0.8 in. (20.4 mm) diameter rod at an extrusion ratio of 18:1 or into 1.2 in.×0.8 in. (30.2 mm×20.6 mm) bar at a 10:1 extrusion ratio. Extrusion was performed on a 750 ton press at 35% throttle setting.

Heat treating experiments determined that the extruded rod material would grow a coarse elongated grain and that zone annealing at an elevated temperature, e.g., at least about 2300° F. (1260° C.), was an effective grain coarsening procedure. The extruded bar material was subjected to hot rolling at temperatures from 2050° F. (1120° C.) to 2250° F. (1230° C.) and at total reductions up to 60% (pass reductions of 20%) with no difficulties being encountered. The hot rolled bars also displayed the capability of growing coarse, elongated grain at high elevated temperatures.

Tensile tests, stress-rupture tests, oxidation tests and sulfidation tests were conducted on alloys in accordance with the invention with the results shown in the following Tables:

TABLE II

TENSILE TEST RESULTS

| Alloy No. | Heat Treatment | Tensile Test Temperature °F. | °C. | 0.2% PS ksi | (MPa) | U.T.S. ksi | (MPa) | El. (%) | R.A. (%) | Modulus psi × $10^6$ | (MPa × $10^3$) |
|---|---|---|---|---|---|---|---|---|---|---|---|
| 1 | A | RT | | 169.4 | (1168) | 183.3 | (1264) | 3.5 | 8.0 | 34.7 | (239.2) |
| | | 1400 | (760) | 166.7 | (1149) | 166.7 | (1149) | 1.0 | 2.5 | 12.8 | (88.2) |
| 2 | B | RT | | 157.8 | (1088) | 176.2 | (1215) | 3.5 | 8.5 | 35.4 | (244.1) |
| | | 1400 | (760) | 152.7 | (1053) | 152.7 | (1053) | 2.0 | 3.0 | 10.6 | (73.1) |
| 3 | B | RT | | 150.0 | (1034) | 169.9 | (1171) | 2.0 | 3.5 | 31.7 | (218.6) |
| | | 1400 | (760) | 151.4 | (1044) | 160.1 | (1107) | 3.5 | 6.5 | 12.3 | (84.8) |
| IN-100(4) | | RT | | 123 | (850) | 147 | (1018) | 9 | — | 31.2 | (215.1) |
| | | 1400 | (760) | 125 | (860) | 155 | (1070) | 6.5 | — | 25.1 | (173.1) |
| DS Alloy M(5) | | RT | | 126 | (869) | 158 | (1089) | 13.1 | 16.7 | 19.4 | (133.7) |
| | | 1400 | (760) | 131.5 | (907) | 166 | (1145) | 11.7 | 22.8 | 13.2 | (91.0) |

Notes:
A Zone annealed at 2340° F.(1280° C.)/2.8 iph (7.1 cmph) and heat treated ½ h/2340° F.(1280° C.)AC.
B Zone annealed at 2330° F.(1277° C.)/2.8 iph (7.1 cmph) and heat treated ½ h/2330° F.(1277° C.)/AC.
(4)As-Cast
(5)Fully heat treated.

TABLE III

STRESS RUPTURE PROPERTIES

| Alloy No. | Heat Treatment | Temperature °C. | °F. | Stress - σ MPa | Ksi | Life Hrs | El. % | R.A. % |
|---|---|---|---|---|---|---|---|---|
| 1 | C + D + E + F | 760 | 1400 | 586 | 85 | 107.2 | 3.8 | 2.6 |
| 1 | C + D + E | 760 | 1400 | 586 | 85 | 79.3 | 2.5 | 3.3 |
| 1 | C + D + F | " | " | " | " | 123.8 | 3.8 | 2.6 |
| 1 | G | " | " | " | " | 181.9 | 1.3 | 3.4 |
| 1 | G | " | " | 689.5 | 100 | 19.5 | 1.3 | 4.7 |
| 1 | G | " | " | 620.5 | 90 | 97.3 | 1.3 | 4.7 |
| 1 | G | " | " | 552 | 80 | 413.6 | 1.3 | 6.1 |
| 1 | C + D + E + F | 1093 | 2000 | 138 | 20 | 9.7 | 1.3 | nil |
| 1 | C + D + E | " | " | " | " | 7.5 | 1.3 | 2.0 |
| 1 | G | " | " | " | " | 14.8 | 1.3 | 2.7 |
| 1 | G | " | " | " | " | 20.4 | nil | 3.3 |
| 1 | G | " | " | " | " | 29.6 | nil | 2.8 |
| 2 | B | 760 | 1400 | 586 | 85 | 68.2 | 1.3 | 2.7 |
| 2 | B | " | " | " | " | 115.4 | 1.3 | 3.3 |
| 2 | B | 1093 | 2000 | 138 | 20 | 3.2 | 2.5 | 4.1 |
| 2 | B | " | " | " | " | 2.4 | 2.5 | 7.3 |
| 3 | B | 760 | 1400 | 586 | 85 | 106.7 | 1.3 | 2.8 |
| 3 | B | " | " | " | " | 127.6 | 2.5 | 2.8 |
| 3 | H | " | " | " | " | 114.8 | 2.4 | 5.0 |
| 3 | H | " | " | " | 90 | 54.3 | 3.2 | 4.2 |
| 3 | H | " | " | " | " | 50.5 | 3.2 | 4.6 |
| 3 | H | " | " | " | " | 52.3 | 2.6 | 2.4 |
| 3 | H | " | " | " | " | 41.0 | 4.0 | 3.4 |
| 3 | B | 1093 | 2000 | 138 | 20 | 53.5 | 1.3 | 1.4 |
| 3 | B | " | " | " | " | 47.9 | 3.8 | 3.4 |
| 3 | H | " | " | " | " | 91.6 | 0.1 | 0.1 |
| 3 | H | " | " | " | " | 37.2 | 1.6 | 0.1 |

Notes:
C Zone annealed at 2370° F.(1300° C.)/2.8 in. per hour (7.1 cm per hour)
D 2 hour at 2360° F.(1295° C.), Fast AC
E 4 hours at 2060° F.(1130° C.), AC
F 24 hours at 1660° F.(905° C.), AC
G Zone annealed at 2370° F.(1300° C.)/2.8 in. per hour (7.1 cm per hour); ½ hour 2370° F.(1300° C.), AC
H Zone annealed ½ hour at 1260° C., 10.2 cm per hour and heat treated 2 hours at 1260° C. air cooled, 2 hours at 954° C., air cooled and 24 hours at 843° C. air cooled.
Density (ρ) for Alloys 1 and 2; 0.289 lb/in$^3$ (8.01 gm/cc) for Alloy 3; 0.286 lb/in$^3$ (7.93 gm/cc)

TABLE IV

CYCLIC OXIDATION TEST RESULTS(1)

| Alloy No. | ΔW Undescaled (mg/cm$^2$) | ΔW Descaled (mg/cm$^2$) |
|---|---|---|
| 1 | −9.56 | −11.22 |
| | −8.39 | ND |
| 2 | −0.146 | −1.47 |
| | −0.201 | ND |
| 3 | −0.881 | −0.183 |
| | −0.865 | ND |
| IN-100 | −2.99 | −7.27 |
| IN-738 | −61.46 | −71.91 |

TABLE IV-continued

CYCLIC OXIDATION TEST RESULTS(1)

| Alloy No. | ΔW Undescaled (mg/cm$^2$) | ΔW Descaled (mg/cm$^2$) |
|---|---|---|
| IN-713C | −14.07 | −15.37 |

Notes
(1)Conditions: 1100° C.(2012° F.), air-5% $H_2O$ flowing at 250 cc/min. Samples cycled to room temperature every 24 hours.
ND = Not determined.

TABLE V

BURNER RIG SULFIDATION TEST RESULTS[1]

| Alloy No | ΔW Undescaled ($mg/cm^2$) | ΔW Descaled ($mg/cm^2$) | Metal Loss (mm) | Maximum Attack (mm) |
|---|---|---|---|---|
| 1 | 24.1 | 35.7 | 0.007 | 0.018 |
| | 24.3 | 35.0 | 0.000 | 0.015 |
| 2 | 71.8 | 83.8 | 0.391 | 0.391 |
| | 65.8 | 79.4 | 0.333 | 0.363 |
| 3 | 184.7 | 205.3 | 0.576 | 0.576 |
| | 179.8 | 205.3 | 0.383 | 0.383 |
| IN-100[3] | 265.0 | 285.8 | 0.851 | 1.034 |
| IN-713C[4] | 158.6 | 412.2[4] | — | — |
| IN-738 | 15.9 | 18.2 | 0.020 | 0.028 |

Notes:
[1]Conditions: 927° C. (1700° F.) for 58 minutes followed by 2-minute air blast. 30:1 air + 5 ppm seawater (ASTM Spec. D1141-52) to fuel (0.3% sulfur JP-5) ratio. Specimens exposed 168 hours with daily cycling and recording of weight change.
[3]Discontinued after 96 hours of test.
[4]Specimen destroyed by test after 168 hours.

TABLE VI

ALLOY RUPTURE STRENGTHS

| Alloy No. | Temperature °F. | Temperature (°C.) | Strength, ksi(MPa) 100-Hour | | 1000-Hour[1] | |
|---|---|---|---|---|---|---|
| 1 | 1400 | (760) | 90 | (620.5) | 76 | (542) |
| | 2000 | (1093) | 19.5 | (134) | 19 | (131) |
| MA 6000E[3] | 1400 | (760) | 80 | (552) | 70 | (483) |
| | 2000 | (1093) | 22 | (152) | 21 | (145) |
| IN-100[4] | 1400 | (760) | 91 | (627) | 75 | (517) |
| | 2000 | (1093) | 9 | (62) | 2 | (14) |
| DS Alloy | 1400 | (760) | 105 | (724) | 90 | (620.5) |
| M[5] | 2000 | (1093) | 10 | (69) | 5 | (34) |

Notes:
[1]Strength levels at 1000-hour test duration are estimated values.
[2]Zone annealed and heat treated ½ h/Z.A. temperature/A.C.
[3]Composition (wt. %): Ni-15Cr-4.5Al-4W-2Mo-2.5Ti-2Ta-0.15Zr-0.01B-1.1$Y_2O_3$, zone annealed and heat treated 2250° F. (1230° C.)/½ h/AC + 1750° F. (955° C.)/2 h/AC + 1550° F. (845° C.)/24 h/AC.
[4]As-Cast.
[5]Fully heat treated.

Figure 2:
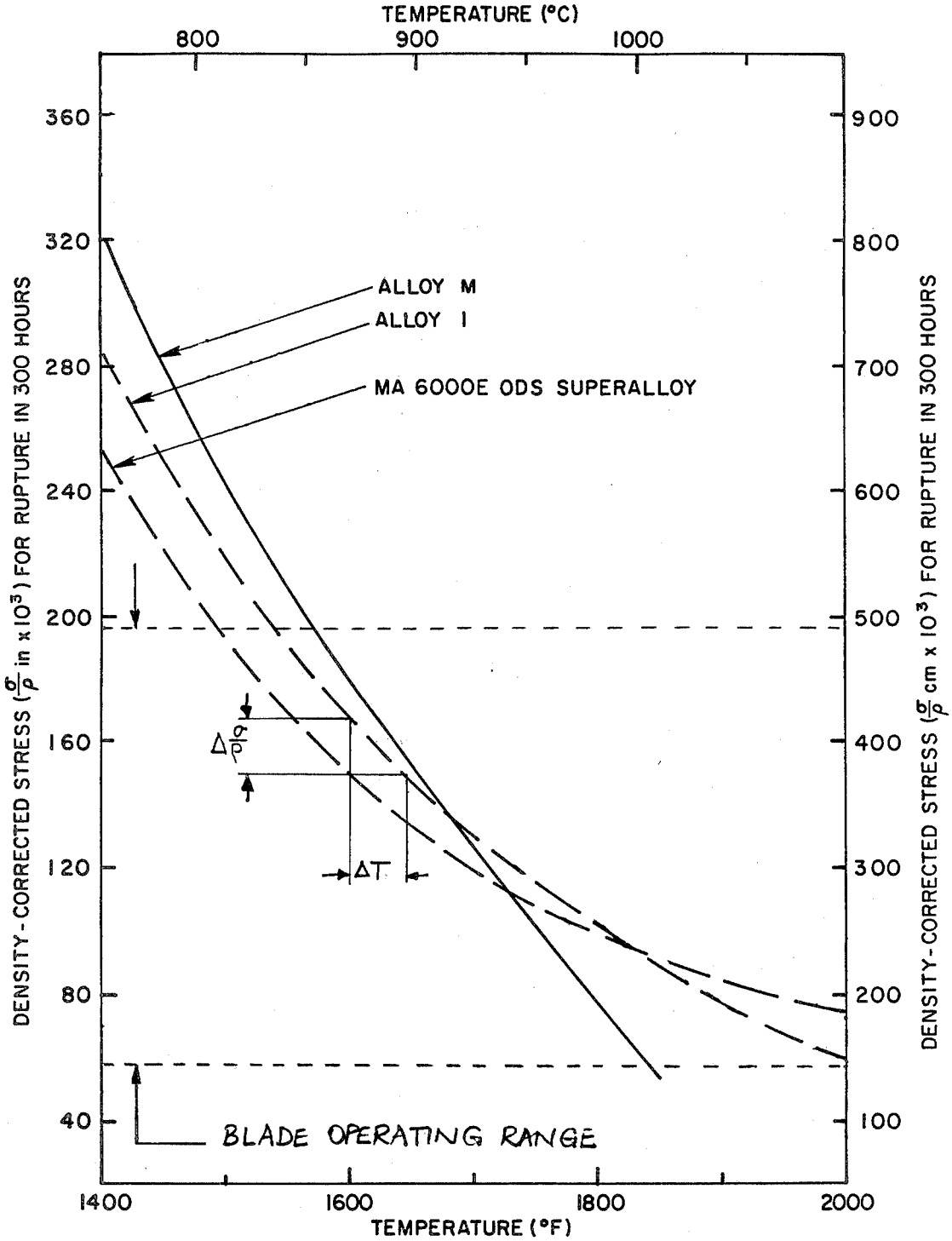
FIG. 2 depicts a graph depicting the stress-temperature profile of an alloy in accordance with the invention as compared to prior art alloys.

As shown in FIG. 2, the high temperature strength properties of Alloy 1 are significantly superior to conventional cast alloys such as directionally solidified Alloy M above ~1675° F. (~913° C.). Also Alloy 1 has higher strength than MA 6000E up to ~1850° F. (~1010° C.) with a minor strength reduction at higher temperatures. At intermediate temperatures Alloy 1 achieves the desired objective of its compositional design; specifically an intermediate specific strength advantage [wherein stress ($\sigma$) is corrected for density ($\rho$), i.e., $$\left(\Delta\frac{\sigma}{\rho}\right)]$$

from ~32 in.×$10^3$ (~81 cm×$10^3$) at 1400° F. (760° C.) to ~16 in.×$10^3$ (40.5 cm×$10^3$) at 1600° F. (871° C.). The critical combinations of stress and temperature are found in the mid-span region of the turbine blade. This region is characterized by operating temperatures of, say, 1600° F. (871° C.). At this temperature, FIG. 2 shows that Alloy 1 demonstrates a specific strength improvement over MA 6000E of $\Delta\sigma/\rho$~16 in.×$10^3$ (~40.5 cm×$10^3$) which represents a significant increase in design temperature capability (ΔT) of ~50° F. (~28° C.). Specifically, compositions typified by Alloy 1 effectively raise the operating stress/temperature envelope for the blade by ~50° F. (~28° C.) while maintaining the large hgh temperature advantages inherent in ODS superalloys such as MA 6000E and the subject alloys. It should be noted that there is still a substantial "unused" allow capability for such alloys at higher fractions of the span. The increase in intermediate temperature operating capability offered by the subject alloys may most usefully be employed in improved blade designs. In particular, the subject alloys are most suited for blade configurations which exploit the unique stress/temperature/time behavior of ODS superalloys over conventional cast alloys.

In general, alloys in accordance with the invention may contain, by weight, about 8% to about 14% or 15% chromium, about 6.5% to about 9% aluminum, about 3.4% to about 7% or 8% tungsten, up to about 4.5 % molybdenum, up to about 4% tantalum, up to about 2.5% niobium, up to about 0.5% zirconium, up to about 0.025% boron, about 0.5% to about 2% yttria, up to about 0.2% carbon, up to about 2% hafnium, up to about 5% or 10% cobalt, up to about 1.5% titanium and the balance essentially nickel. Impurities such as iron up to about 3%, nitrogen up to about 0.3%, oxygen up to about 1% may be present. The yttria employed will usually have an average particle size of about 200 to 400 angstrons.

The significant components of the alloy composition are chromium, aluminum, tungsten, yttria and nickel. Chromium contributes corrosion resistance, for which purpose at least about 8% or more preferably 10% is employed. Above about 14% or 15% chromium in the alloys, difficulties can be encountered in obtaining secondary recrystallization. Aluminium is the principal gamma prime ($\gamma'$) former employed. While small amounts of titanium, niobium and tantalum may also be present, use of these elements can lead to difficulties in securing the desired grain structure. Tungsten is a most important element for securing strength in the alloy. It may be supplemented by molybdenum. Boron and zirconium contribute strengthening particularly of grain boundaries, but these elements may be dispensed with in the interest of securing most favorable grain structures upon secondary recrystallization. Yttria is the desirable dispersion-strengthening ingredient. Nickel is the base element for the alloy and may be replaced with cobalt in amounts up to 10%.

The alloys are characterized by a high $\gamma'$ content, e.g., 50% or 60% of gamma prime phase even at temperatures on the order of 2000° F. (1093° C.). This is illustrated in FIG. 1 of the drawing. FIG. 1 being a reproduction of a photomicrograph taken at 4900 diameters of an extruded bar specimen from Alloy 1 which had been zone annealed at 2340° F. (1280° C.) at 2.8 inches (7.1 cm) per hour followed by a ½ hour anneal at 2340° F. (1280° C.) air cool. In the photomicrograph, the blocky areas are $\gamma'$, representing about 70% of the area depicted.

It is considered that the capability of retaining a large of amount of $\gamma'$ phase in the alloy structure contributes improved strength to the alloy over a range of temperatures. It appears, however, that secondary recrystallization, another important requirement in order to secure growth of coarse elongated grains of high aspect ratio, occurs at or above the $\gamma'$ solvus temperature. The composition of the alloy accordingly must be such that a large proportion of $\gamma'$ is retained to a high temperature, e.g., 2000° F. (1093° C.), but that the so-retained $\gamma'$ be dissolved upon heating to even higher temperatures but below the melting point of the alloy. Alloy 3 was found to display a secondary recrystallization temperature range of approximately 100° F. (55° C.); i.e., between about 2280° F. (1249° C.) and about 2380° F. (1304° C.); whereas the corresponding temperature range for Alloys 1 and 2 was much narrower. A grain aspect ratio (length to diameter) of 15:1 or more is desirable, and was achieved in alloys of the invention by appropriate heat treatment, including zone annealing to achieve secondary recrystallization.

We claim:

1. An oxide dispersion strengthened alloy produced from mechanically alloyed powder consisting essentially of about 8% to about 14% chromium, about 6.5% to about 9% aluminum, about 3.4% to about 8% tungsten, up to about 4.5% molybdenum, up to about 4% tantalum, up to about 2.5% niobium, up to about 0.5% zirconium, up to about 0.025% boron, up to about 0.2% carbon, up to 2% hafnium, up to about 10% cobalt, up to about 1.5% titanium, about 0.5% to about 2% yttria and the balance essentially nickel.

2. An alloy according to claim 1 heat treated to form coarse elongated grains having an aspect ratio of at least 15:1.

3. An alloy according to claim 1 containing about 11.3% chromium, about 7.3% aluminum, about 6.4% tungsten, about 1.7% molybdenum, about 3.2% tantalum, about 1.6% niobium, about 0.15% zirconium, about 0.01% boron, about 1.1% yttria and the balance essentially nickel.

4. An alloy according to claim 1 containing about 13.9% chromium, about 7.4% aluminum, about 6.5% tungsten, about 1.7% molybdenum, about 1.6% tantalum, about 0.15% zirconium, about 0.01% boron, about 1.1% yttria and the balance essentially nickel.

5. An alloy according to claim 1 containing about 9.3% chromium, about 8.5% aluminum, about 6.6% tungsten, about 3.4% molybdenum about 0.15% zirconium, about 0.01% boron, about 1.1% yttria and the balance essentially nickel.

6. An alloy according to claim 1 containing about 9.3% to about 13.9% chromium, about 7.3% to about 8.5% aluminum, about 6.4% to about 6.6% tungsten, about 1.7% to about 3.4% molybdenum, up to about 3.2% tantalum, up to about 1.6% niobium, and the balance essentially nickel.

7. An aircraft engine hot section component made of the alloy of claim 1.

* * * * *